United States Patent [19]

Berg

[11] 4,414,788

[45] Nov. 15, 1983

[54] METHOD AND MEANS FOR PACKAGING EXPANSIBLE PRODUCTS

[76] Inventor: Allan Berg, 85 Alhambra Dr., Oceanside, N.Y. 11572

[21] Appl. No.: 269,358

[22] Filed: Jun. 1, 1981

[51] Int. Cl.[3] ..... B65B 1/24

[52] U.S. Cl. ..... 53/436; 53/266 R; 53/467; 53/527; 206/83.5; 206/499; 229/17 B

[58] Field of Search ..... 53/436, 467, 527, 475, 53/266 R, 484, 485, 526; 206/83.5, 499; 229/17 B

[56] References Cited

U.S. PATENT DOCUMENTS

| | | | |
|---|---|---|---|
| 1,557,881 | 10/1925 | Rogers | 53/436 X |
| 3,541,752 | 11/1970 | Ness | 53/527 X |
| 3,557,683 | 1/1971 | Boyd | 53/527 X |
| 3,586,206 | 6/1971 | Gilmore | 206/499 X |
| 3,604,339 | 9/1971 | Beck | 100/219 X |

*Primary Examiner*—Kuang Y. Lin
*Assistant Examiner*—Charles L. Willis
*Attorney, Agent, or Firm*—Bauer & Amer

[57] ABSTRACT

Method and means are provided for applying a compressing force to normally expanded products to compact the same and while the products are compressed they are held in this condition by retaining means that permit the compressing force to be removed and afford access to the compactly compressed products to enable them to be enclosed in a package.

13 Claims, 11 Drawing Figures

METHOD AND MEANS FOR PACKAGING EXPANSIBLE PRODUCTS

BACKGROUND OF THE INVENTION

The present invention relates generally to method and means for compacting expansible products that may be compressed into smaller size for compact packaging. More particularly, it teaches a method and means wherein one or more of normally expanded products are compressed and compacted within a container, as a carton, by the use of a compacting or compressing force applied by a convenient hydraulically or pneumatically operated platen of a press and retained compressed therein by the use of a retainer inserted into the container.

Bulky air filled or otherwise expanded but compressible products such as, for example, sleep pillows, by reason of their fibrous filler material which cause them to entrap air, require a greater area in their normal, expanded condition than would otherwise be required if the products were compressed and the air would be removed therefrom. As can readily be appreciated if such expanded products were packaged for shipment in such normal uncompressed condition, they would require larger shipping packages or containers than if their size can be materially reduced. The result can effect substantial savings in storage space, shipping costs and the lowered cost of smaller cartons and other containers.

Many different methods for compressing such bulky normally expanded or enlarged compressible products have been heretofore used. For example, certain of such methods employ a vacuum device for compressing the products during packaging with the vacuum being stopped upon completion of the packaging operation. Other methods include the use of a platen which compresses the products in the package or carton. Typical platen press devices are described, for example, in U.S. Pat. Nos. 3,307,320 which issued to Andrew J. Harriss, Jr. et al on Mar. 7, 1967; 3,541,752 which issued to Irving Ness on Nov. 24, 1970; 3,557,683 which issued to John A. Boyd on Jan. 26, 1971; 3,824,758 which issued to Joel C. Hart et al on July 23, 1974; 3,925,962 which issued to Werner Knopf et al on Dec. 16, 1975; and 4,121,399 which issued to Emile Verville on Oct. 24, 1978.

While all of the aforementioned prior art patents teach some variation of a method and/or apparatus for compressing bulky products utilizing a platen press, each of said methods and/or apparatuses, all suffer in their failure to teach the ability to positively retain the bulky product in its compressed state during completion of the packaging operation. The reason for this shortcoming is a problem inherent in the basic design of the prior art method and apparatuses.

Against the foregoing background, it is a primary object of the present invention to provide a method and means for compressing bulky, normally expanded products for compact packaging.

It is another object of the present invention to provide a method and means for use in compressing bulky products into a compact package utilizing a press for compressing and decreasing the size of the bulky products.

It is still another object of the present invention to provide a method and means for use in compressing bulky products for compact packaging wherein a force applying press is used for compressing the products, and independent retention means is employed to retain the products in their compressed condition for packaging after withdrawal of the compressing force of the press.

It is yet still another object of the present invention to provide a method and means for compressing bulky, expanded products for packaging as described herein wherein the independent compression retention means is removable from the package after completion of the packaging operation.

It is still yet another object of the present invention to provide a method and means for compressing bulky products for packaging as described herein wherein guide means are provided to insure that the independent compression retention means do not damage the products that are compressed compactly within their carton or other container.

BRIEF DESCRIPTION OF THE DRAWINGS

In order that the manner in which the foregoing and other objects achieved according to the invention can be understood in detail, an embodiment thereof is described with reference to the accompanying drawings wherein.

DESCRIPTION OF THE PREFERRED EMBODIMENTS

Figure 1:
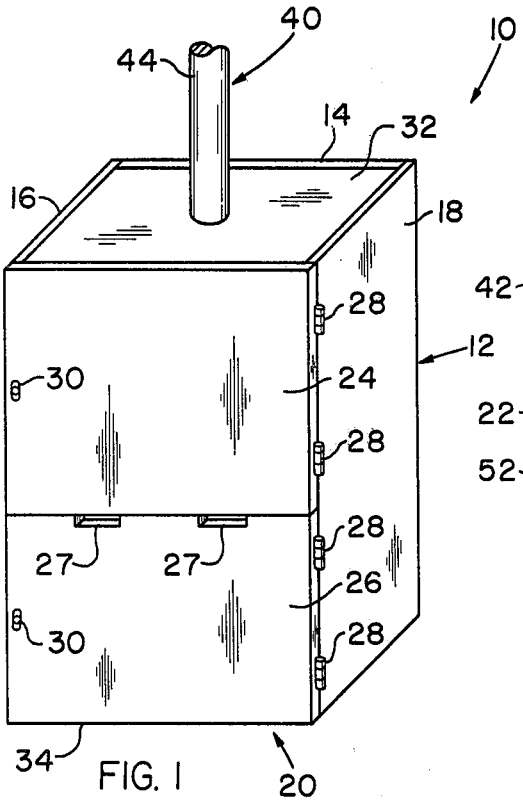
FIG. 1 is a perspective view illustrating the cabinet of the apparatus constructed according to the present invention.
Figure 2:
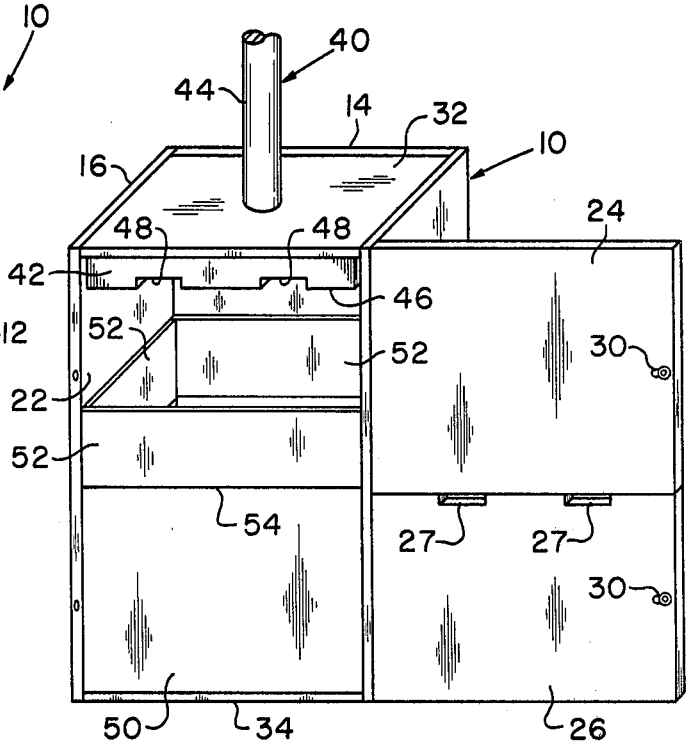
FIG. 2 is a front view of the cabinet with a container positioned therein and prior to the introduction of the compressible products thereinto.

The compression or compacting apparatus of the present invention is referred to generally by reference numeral 10 and is illustrated in FIGS. 1 and 2. It includes an enlarged compression or compacting cabinet generally identified 12, having a back 14 interconnecting with a pair of opposed, substantially imperforate sides 16 and 18. A front side, generally identified 20, permits access to the interior 22 of the cabinet 12 and may be opened and closed by upper and lower doors 24 and 26, respectively. Upper and lower doors 24 and 26 are hinged by a plurality of hinges 28 to one of said pair of opposed sides 18 and securing means, preferably a latch or clasp 30, are provided on both upper and lower door 24 and 26, respectively, to secure the respective door closed to the opposite side 16 of the cabinet 12. When both upper and lower doors 24 and 26 are closed, the interior 22 of the cabinet 12 is substantially enclosed on all four sides.

The lower door 26 is of a height substantially equal to the height of a container or carton 50 which is adapted to be used in the cabinet 12 as shown in FIG. 2. Similarly, the height of upper door 24 is substantially equal to or slightly greater than the height of the normally expanded products 60 to be compressed or compacted into the container or carton 50 as shown, for example, in FIG. 11.

The top 32 and the bottom 34 of the cabinet 12 may be closed as shown in FIGS. 1–2 or left open. In certain instances it may be preferred to leave the top 32 of the cabinet 12 open to permit usage of a number of cabinets 12 on a conveyor system to enable more than one compacting cabinet 12 to be used with the same compressor structure or platen 42 to be described.

At least one and preferably at least two cutout apertures or slots 27 are provided at the upper edge of lower door 26. At least one and preferably two of corresponding slots 15 are provided through the back wall 14 of the cabinet 12, as shown, for example, in FIG. 8.

A compressor or compacting means 40 is provided within and projects through the top 32 of the cabinet 12 for applying a compressive force to the bulky products 60 to compress the same compactly into the container or carton 50. Compression means 40 includes a press platen 42 similarly configured although smaller than the interior 22 of cabinet 12. The compressor platen 42 is connected by piston rod 44 to an external actuating and powering means (not shown) which may be of conventional design. The compressor platen 42 may be activated and powered, that is, raised and lowered within cabinet 12 by a piston operated mechanism, by an hydraulic mechanism or by any other convenient mechanical mechanism, none of the details of which form a part of the present invention.

Figure 3:
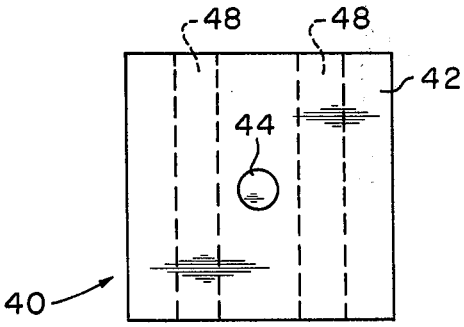
FIG. 3 is a top view of the platen used in the apparatus.
Figure 5:
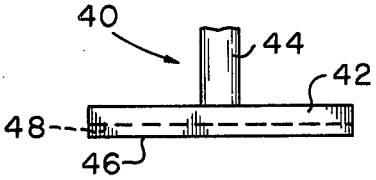
FIG. 5 is a side view of the platen.
Figure 4:
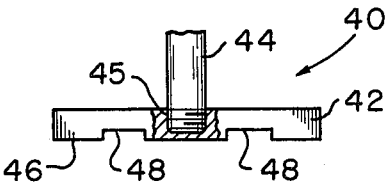
FIG. 4 is a front view of the platen.

As shown in greater detail in FIGS. 3–5, the compressor platen 42 is secured to piston rod 44 by conventional securing means as threads 45 engaging the lower end of piston rod 44 within the center of press platen 42. At least one and preferably two guide means that may be shaped as grooves or slots 48 are provided in the surface 46 on the underside of the platen 42 and extend longitudinally from the front to the back thereof. The guides or grooves 48 in the platen 42 are so positioned as to be in axial alignment with slots or cutout apertures 27 on the lower door 26 and slots 15 on the back of the cabinet 12 when the platen 42 is lowered to its final compacting position.

The operation of the apparatus 10 of the present invention is shown sequentially in FIGS. 2 and 6–9. As shown in FIG. 2, the cabinet 12 is readied for convenient use by opening both upper and lower doors 24 and 26, respectively, and by inserting in the lower portion of cabinet 12 on the surface 34 the container or carton 50 in which the bulky products are to be compactly packaged. The compression force applying platen 42, during the insertion of the carton 50 and during the subsequent locking operation, is in an "up" position with the platen 42 being raised fully to its position at the top of the cabinet 12. The carton 50 is shown as a typical cardboard box of the type having a plurality of closed sides and a closed bottom. A plurality of top closing flaps 52 extend upwardly from the sides of the carton 50. After the products are compacted within the carton as will be described, the package is sealed closed by folding inwardly and downwardly the top flaps 52 at crease lines 54 and thereafter sealed closed.

As shown in FIG. 2, the carton 50 is inserted into the bottom of the cabinet 12 with all the top closing flaps 52 arranged in an upwardly extending position to permit complete access to the carton 50 through the open top thereof. From FIG. 2 it will be seen that the carton 50 is inserted in such a manner that the crease lines 54 of the carton 50 are positioned slightly above the top of the lower door 26. It is, of course, appreciated that cartons 50 may vary widely in configuration and size. Hence, it is recognized that it may be necessary to raise or lower the carton 50 within the cabinet 12 to accommodate for such differences. In practice, the empty space above the carton will be high enough to accommodate a large number of the products 60.

Figure 6:
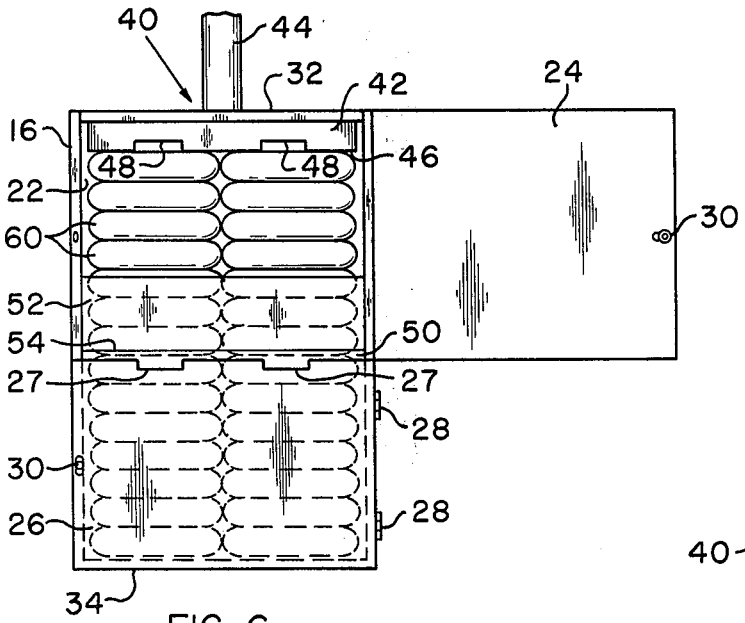
FIG. 6 is a front view of the apparatus after introduction of the compressible products into the container and into the cabinet interior and with the lower cabinet door closed.

Upon proper placement of the carton 50 within the cabinet 12, as shown in FIG. 6, the lower door 26 of the cabinet 12 is closed and the bulky enlarged products 60 to be compacted and packaged are inserted through the open upper door portion of the cabinet 12 not only filling the carton 50 but also substantially all of the cabinet 12 above the carton 50. FIG. 6 depicts the bulky products 60 as sleep pillows, it being understood that the compacting apparatus 10 of the present invention may be used in association with and to compactly package virtually any type of bulky, compressible products, including, for example, comforters, decorative pillows, foam and the like.

Upon introduction into the cabinet 12 of all of the products 60 desired to be compressed and packaged into the carton 50, the upper door 24 is then closed and the compacting or compressing operation commences. Upper door 24 is closed during the pressing or compacting operation to prevent possible injury to the operator and to restrictively guide the movement of the products 60 during the compression stroke. After closing the upper door 24, the only openings accessible to the interior of the cabinet 12 are at the slots 27 on the lower door 26. It will be appreciated that the density of the products 60 to be packaged may vary widely and it is, therefore, understood that the size, number and shape of the products 60 to be introduced into the cabinet may not always fill the entire upper door portion of the cabinet 12 as shown in FIG. 6. It is, therefore, contemplated that based on the density and compactability of the product as well as the ultimate packaging requirement, the press means 40 and the press platen 42 may be raised or lowered to a predetermined position prior to introduction of the products 60 to provide a fixed height and volume in which the operator may load.

Figure 7:
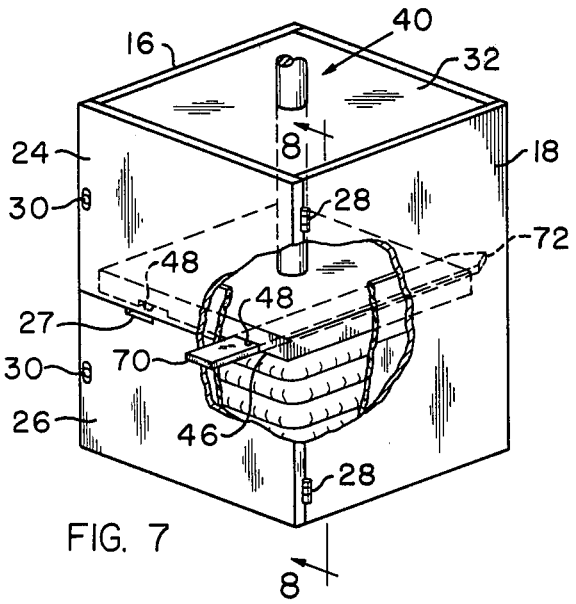
FIG. 7 is a perspective view of the cabinet with its upper and lower doors closed, the platen shown in its lowered compressed mode and a retaining means inserted in position as seen through a partial section of the cabinet.
Figure 8:
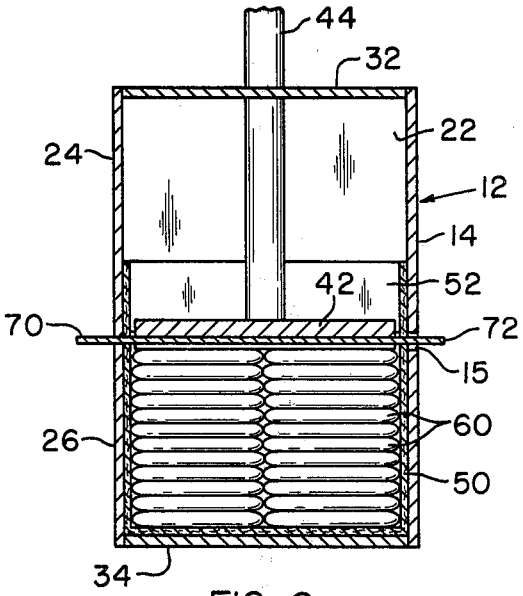
FIG. 8 is a cross-sectional side view taken along line 8—8 of FIG. 7.

As shown in FIGS. 7 and 8, the compressing or compacting operation is accomplished by activating the force applying compressor means 40 by external controls (not shown) and causing the platen 42 to lower and thereby compress the bulky products 60 within carton 50. Platen 42 is of a like configuration although somewhat smaller in dimension than the interior cavity of the carton 50 and its downward compressive movement may be selectively terminated when the lower surface of the press platen 42 actually enters the interior of the carton 50 below the crease line 54 wherein the slots 27 of the lower door 26 and the slots 15 on the back wall 14 of the cabinet 12 are in axial alignment with the apertures or grooves 48 on its underside 46.

Upon completion of the selected compressing or compacting stroke the products 60 are then tightly compressed and compacted within the interior of the carton 50. As shown in FIGS. 7 and 8, while the products 60 are retained in such a compacted and compressed condition within the interior of the carton 50 by the platen 42, at least one and preferably at least two retention means in the form of rigid bars or slats 70 are then forcibly inserted through the opening defined by slots 27 in lower door 26 and below the lower edge of the upper door 24. The number of retention bars 70 employed may vary in accordance with the size and density of the products 60 being compacted and the size and shape of the carton 50 in which the products 60 are to be packaged.

The retention bars 70 are preferably pointed at their forward end 72 to permit them to be able to pierce and pass easily through the adjacent wall of the carton 50 which it penetrates below the crease line 54 while being guided in their movement within the guide grooves 48 on the underside of the platen 42. As they are moved along the guides 48 they will then pierce and spear through the opposite sidewall of the carton 50 below the crease line 54 and then extend and project outward through the slots 15 on the back wall 14 of the cabinet 12. Overinsertion of the retention bars 70 into the cabinet 12 may be prevented by a stop (not shown) that may be mounted behind the slots or apertures 15 or by providing the spearing retention means 70 with enlarged operating handle (not shown) that will be free of interference with the operation of the doors 24 and 26. The height of the guide grooves 46 within the platen 42 is sufficient to assure that the spearing retention means 70 do not damage the products 60 that are pressed down by the lower surface 46.

Figure 9:
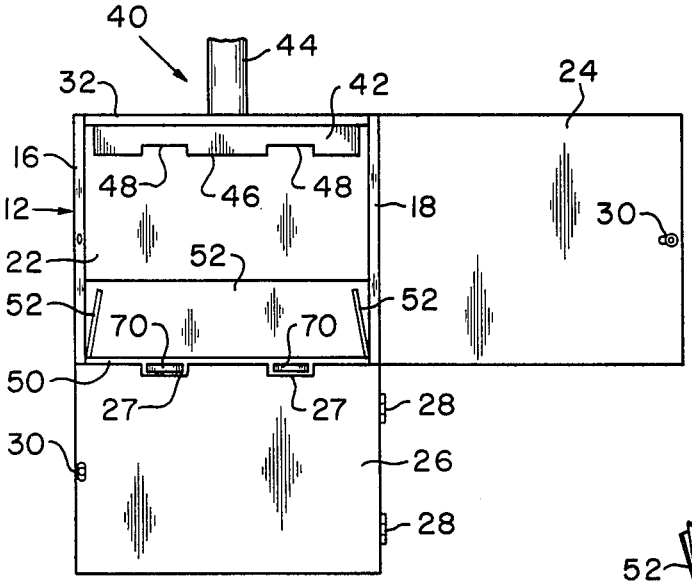
FIG. 9 is a front view of the compacting apparatus after the raised withdrawal of the platen.
Figure 10:
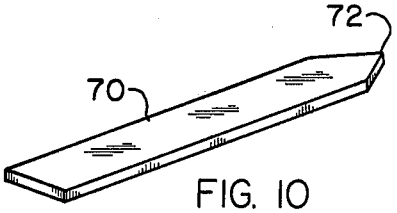
FIG. 10 is a perspective view of a retaining means.
Figure 11:
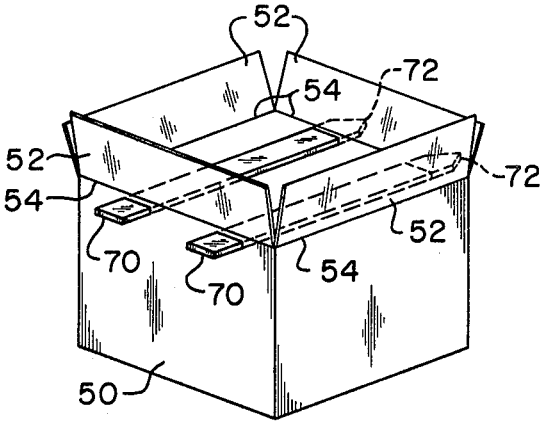
FIG. 11 is a perspective view of an open container removed from the cabinet with the retaining shown positioned therein before closure of the container.

After one or more of the retention means 70 are inserted into and through the interior 22 of the cabinet 12, they assume and substitute for the product compression function of the platen 42. This permits the platen 42 to be raised to its "up" position by the external control means (not shown) free of the products. Decompaction of the compressed products 60 within carton 50 is now prevented by the restraint then imposed upon and above them by the retention bar means 70. The upper door 24 of the cabinet 12 is then opened as shown in FIG. 9 to expose the top closure flaps 52 of the carton 50 which are then manually folded along crease lines 54 to close over the carton 50 to form a top thereof. After they are secured closed, the retention bars 70 then may be withdrawn because the secured flaps 52 will retain the products compressed. The carton 50, including the compacted goods 60, is then removed from the cabinet 12 by opening the lower door 26. If desired, the carton 50 may be sealed outside the cabinet 12 by removing it therefrom with the retention means 70 intact therewith as shown in FIG. 11.

It is understood that it may be desirable to utilize retention bars (not shown) of the type which can be inserted into the carton 50 to be left therein to be a physical part thereof after sealing the carton. In practice, it is possible to use a container similar to the carton 50, but without the integral closure flaps 52 so that the container may be open at its top. Such container will be used in the same manner as previously described herein, except that a cover may be applied to its open top before the retention means 70 are removed from the opposite walls thereof so as to hold the expandable products 60 compressed within the container until the closure cover can be secured in place.

Although it is recognized that the container 50 has been shown in the form of a carton box having foldable flaps to close the opening thereof, it should be clear to those skilled in the art that any type container 50 may be employed within the scope of the teaching of the invention. Hence, the terms container and carton have been used interchangeably without the intention of limiting their interpretation. Much the same is true for the interchangeable use of the terms compressor and compactor and their variations. The use of one of such terms is intended to include the other with the intent that they be considered to mean substantially the same.

As many different embodiments of the present invention may be made without departing from the spirit and scope thereof, it is understood that the invention should only be limited by the following claims.

What is claimed is:

1. In a method for packaging products in a container having an opening comprising the steps of:

inserting the container into a compressing apparatus having a side opening, placing the products so as to be introduced into the apparatus and the container through the apparatus opening and container opening;

closing the apparatus opening;

applying a force to compress the products into the container by a compressor in the apparatus;

retaining the products compressed in the container by the insertion of retention means through the closed sides of the apparatus and into the container;

removing the compression force from the products without removing the compressor from the apparatus while the products are retained compressed in the container by the retention means, opening the apparatus side opening while the retention means is still in the apparatus to provide access to the container and to the retention means still in the sides of the container, and closing the container about the products held compressed therein only by the retention means without the compressing force removing the container from the apparatus either before or after said closing of the container;

and removing the retention means from the container after the container is closed.

2. In the method of claim 1, wherein the step of inserting retaining means further comprises inserting the retaining means through the walls of the container while the compressing force is applied to the products.

3. In a method for packaging expansible products in their fully expanded condition in a container, said method comprising the steps of:

introducing into a compressing apparatus having a side opening at least a container having an interior accessible through at least one open side thereof;

further introducing into the compacting apparatus through the side opening thereof products in their fully expanded condition to be packaged within the container through the container opening;

compressing the products from their expanded condition into the container through the open side thereof;

applying retainer means through the container to retain the products compressed in the container;

releasing the compression from the products to permit them to expand but retained compressed by the applied retainer means, and removing the container with the retainer means from the side opening of the apparatus while products are retained compressed therein by the applied retainer means.

4. In the method of claim 3, further including the step of closing the open side of the container.

5. In the method of claim 4, wherein said closing step occurs before said step of removing the container.

6. In the method of claim 3, wherein the retainer means is inserted through the container while the same is in the compressing apparatus.

7. In the method of claim 6, further including the step of removing the retainer means after closing the open side of the container.

8. A method for the compact packaging of products from their normally expanded condition comprising the steps of:

providing a compacting cabinet including a plurality of sides defining an enclosure accessible through upper and lower doors, in which the lower door includes at least one aperture, the compacting cabinet further includes operable compressing means moveable in the cabinet through an opening separate from the doors and having a groove longitudinally extending along the undersurface thereof;

placing in the compacting cabinet through the lower door at least one packaging container having flaps to close an opening;

introducing into the compacting cabinet through the upper door thereof the products to be compactly packaged in the container through its opening;

closing the upper and lower doors;

operating the compressing means to compact the products within the interior of the container;

inserting retention means through the aperture included in the lower door to pierce at least opposite sides of the container and to pass within the groove of the compressing means to extend across the top of the compressed products;

withdrawing the compressing means;

opening the upper door;

closing the flaps to close the opening of the container;

opening the lower door while the retention means is still in the cabinet;

and removing the retention means from the container sides.

9. A method as in claim 8, further including the step of removing from the cabinet the container with the compressed products retained by the retention means and sealing the container after removing it from the cabinet.

10. A method as in claim 8, wherein said step of closing the flaps occurs while the container is still in the cabinet and is followed by removing the container from the cabinet.

11. Apparatus for use in the compact packaging in a container of products compressed from their normal expanded condition comprising:

a compacting cabinet having a plurality of sides defining an enclosure, at least a side door on said cabinet through which said enclosure is accessible, said door including at least an aperture;

compressing means movable in said cabinet other than through said side door and including guide means therein, said compressing means being movable downwardly within said cabinet to compress the products compactly within the container;

and retention means insertable through said aperture to pierce the packaging container and move along said guide means while the products are compressed within the container to retain the products compressed to enable said compressing means to release its compression of the products by moving upwardly within the cabinet, said retention means engaging the products in the container to retain them compressed, and said door being openable while said retention means is still in said container and cabinet so that the container and compressed products may be removed from the cabinet side door without necessitating displacement of said compressing means from said cabinet and permitting closure of the container within and also outside the cabinet before removal of said retention means from the container and closure of the same.

12. In an apparatus having a cabinet for packing compressible products in a container positioned in said cabinet to receive the compressible products and closable about the products to contain the same compressed in a closed package, compressing means movable in a side of said cabinet to compress the products into the container through an opening in the container closeable by flaps thereon, and removable retention means movable through sides of said cabinet other than said side in which said compressing means moves and into engagement with apertured walls of the container while the products are compressed in the container by said compressing means to retain the products compressed therein, said retention means engaging said apertured walls such that when said compressing means is moved away from the compressed products said retention means engaged with said apertured walls retain the products compressed within the container to enable the opening of the container to be closed to form a package of the compressed products without restriction as to whether the container is within or outside of said cabinet, the container having flaps to close the opening and wherein the flaps are closed over said retention means to close the container opening and to enable said retention means to be removed from the container while the container is still in said cabinet, said retention means being removable from engagement with the apertured walls of the container to permit the compressed products to expand after the container flaps close the opening over said retention means, and said other side being openable while said retention means is still in said container.

13. In an apparatus as in claim 12, said compressing means having means defined therein to enable said retention means to move above the compressed products into engagement with opposed walls of the container.

* * * * *